United States Patent [19]

Savio et al.

[11] 4,384,715

[45] May 24, 1983

[54] KNEE EXERCISER

[75] Inventors: Dino M. Savio, Belleair; John P. Barrett, Jr., Clearwater, both of Fla.

[73] Assignee: John P. Barrett, Jr., Clearwater, Fla.

[21] Appl. No.: 217,414

[22] Filed: Dec. 17, 1980

[51] Int. Cl.[3] ..... A63B 21/04

[52] U.S. Cl. ..... 272/136; 272/141; 272/900; 272/143; 272/DIG. 5

[58] Field of Search ..... 272/141, 143, 900, 136, 272/135; 73/380

[56] References Cited

U.S. PATENT DOCUMENTS

| | | | |
|---|---|---|---|
| 1,052,962 | 2/1913 | Reach | 272/118 |
| 1,969,165 | 8/1934 | Turner | 272/136 |
| 2,825,222 | 3/1958 | Lindenauer et al. | 73/380 X |
| 4,116,434 | 9/1978 | Bernstein | 272/900 X |

FOREIGN PATENT DOCUMENTS

| | | | |
|---|---|---|---|
| 362670 | 1/1922 | Fed. Rep. of Germany | 73/380 |

*Primary Examiner*—Richard C. Pinkham
*Assistant Examiner*—William R. Browne
*Attorney, Agent, or Firm*—Harvey B. Jacobson

[57] ABSTRACT

A vertically elongated tube houses a compression coil spring reacting between one end of a cable within an upper end portion of the tube and a tube anchoring frame to develop an exercising force transmitted by the cable. A pulley from which the cable extends externally from a lower end portion of the tube to a body harness, guides cable movement under forces applied through the cable at an angle to the tube within a wide range.

6 Claims, 2 Drawing Figures

KNEE EXERCISER

BACKGROUND OF THE INVENTION

This invention relates to an exercising device through which physical therapy may be applied to portions of a person's body for treatment of various injuries, such as knee injuries.

Therapeutic exercising devices wherein a body harness is connected to a cable for displacement against the bias of a spring mechanism is well-known, as disclosed for example in U.S. Pat. Nos. 1,416,741, 3,659,846 and 4,026,548. The anchoring of such exercising devices to the lower end of a door is also well-known as disclosed in U.S. Pat. Nos. 4,116,434 and 4,185,816. Such exercising devices are limited in use because of installation, location of the injured body portion to be treated and provide little or no guidance with respect to the exercising force being applied.

It is therefore an important object of the present invention to provide an exercising device of the aforementioned type, which is more versatile in use and provides a wide range of exercising forces capable of being monitored.

SUMMARY OF THE INVENTION

In accordance with the present invention, a force transmitting cable extends from the lower end portion of an anchored vertical tube, within a wide angular range to a body harness at a desired injury site. Displacement of the cable is guided by means of a pulley within the lower end portion of the tube from which the cable extends upwardly through a compression coil spring to a spring abutment within the upper end portion of the tube. The spring reacts between the frame anchoring the tube and the upper end of the cable within the tube to develop the exercising force which is registered on a scale mounted externally on the tube by means of a pointer projecting from the spring abutment through a guide slot in the tube.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWING FIGURES

DETAILED DESCRIPTION OF PREFERRED EMBODIMENT

Figure 1:
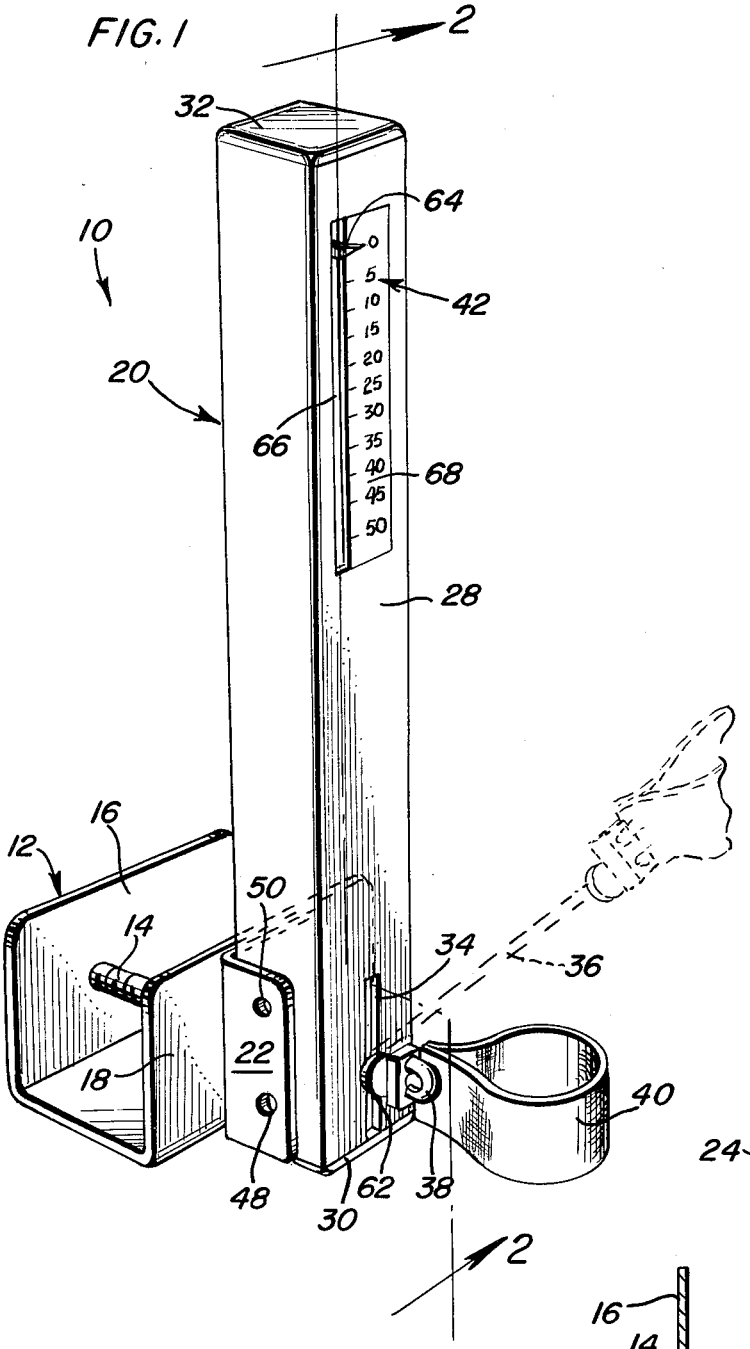
FIG. 1 is a perspective view of the exercising device.
Figure 2:
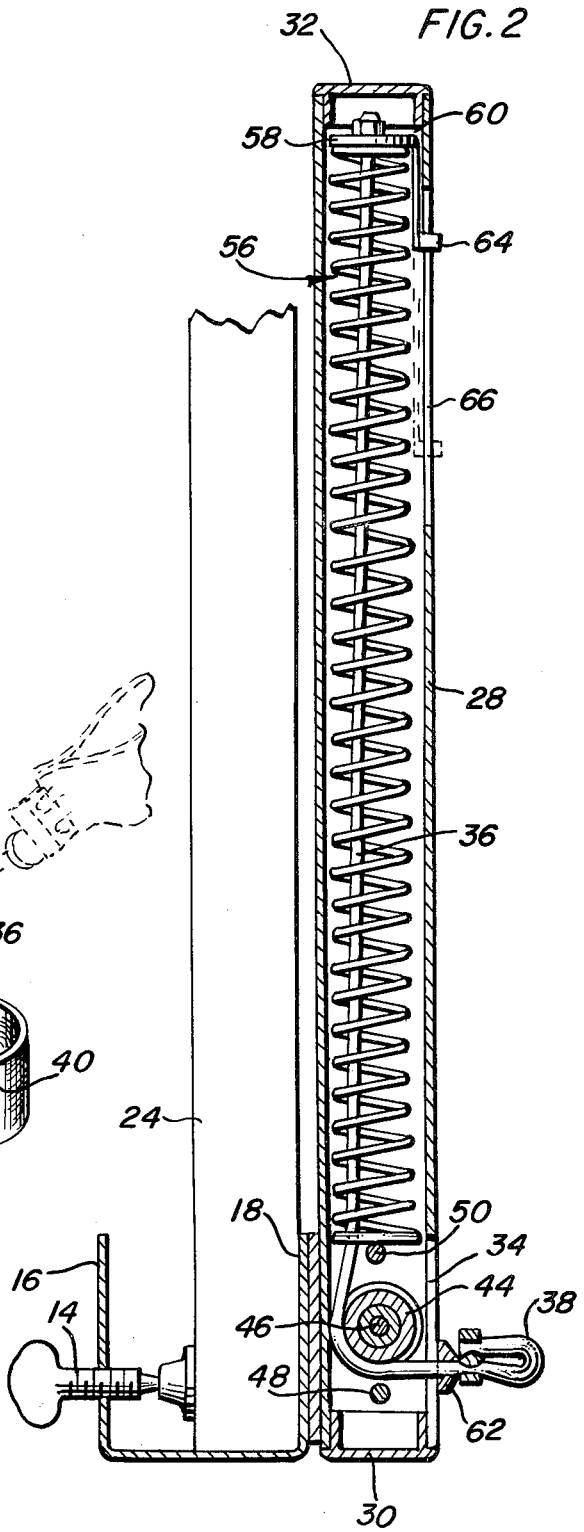
FIG. 2 is a side sectional view taken substantially through a plane indicated by section line 2—2 in FIG. 1.

Referring now to the drawings in detail, FIG. 1 illustrates the exercising device of the present invention, generally referred to by reference numeral 10. The device 10 includes an anchoring frame 12 in the form of an upwardly opening channel member having a clamp 14 mounted on the channel leg 16 opposite channel leg 18 to which a vertically elongated tubular housing 20 is secured by means of a U-shaped bracket 22 welded or otherwise fastened to the frame 12. The frame 12 is adapted to be secured by clamp 14 to an anchorage such as the lower end portion of a door 24 as shown in FIG. 2. The tubular housing 20 will thereby be supported in the vertical portion shown slightly elevated above a floor surface.

The tubular housing 20 includes a tube 28 having a lower end portion embraced between the parallel leg portions of the bracket 22 and closed by means of a threaded cover 30. A similar cover 32 closes the upper end portion of the tube 28 spaced above the frame 12. A slot 34 is formed in the tube at the lower end portion through which a force transmitting cable 36 extends. One end of the cable externally of the housing 20 is connected by a loop formation 38 to a body harness 40, such as a foot strap. A force indicating device generally referred to by reference numeral 42 is positioned on the housing 20 adjacent the upper end portion in order to register the exercising force developed in the cable when displaced during exercising operations.

As shown in FIG. 2, a pulley 44 is rotatably mounted within the lower portion of the housing 20 by means of a support shaft 46 bridging those walls of the tube 28 abutting the leg portions of the bracket 22. Riveted assembly pins 48 and 50 extend through the bracket 22 and tube 28 to interconnect the same at locations closely spaced below and above the pulley. The pulley is centrally positioned by spacers on shaft 46 for alignment with the slot 34 from which the cable 36 extends externally of the tubular housing.

The cable is guided in its movement by the pulley 44 about which it is entrained in order to accommodate extension of the cable at various angles from the lower end portion of the housing and vertical extension upwardly through the housing within a spring mechanism generally referred to by reference numeral 54. The spring mechanism includes a compression coil spring 56 supported at its lower axial end on the assembly pin 50 above the pulley. At its upper axial end, the spring 56 bears against an abutment disc 58 that is held in engagement with a cable stop 60 by the bias of the spring. Thus, the spring 56 under compression reacts between the frame and one end of the cable within the upper end portion of the housing 20 to maintain a retracting bias on the cable. Another stop element 62 is secured to the cable externally of the housing adjacent to the loop portion 38 so as to limit retraction of the cable into the housing by abutting the housing at the slot 34.

The force indicator 42 aforementioned, includes a pointer 64 connected to the spring abutment disc 58 as more clearly seen in FIG. 1. Movement of the pointer is guided by a sot 66 in the tube adjacent the upper end portion thereof, through which the pointer projects from the disc 58. Force indicating indicia or scale 68 is mounted externally on the tube extending parallel to and alongside of the guide slot 66 in order to provide force readings corresponding to the displacement of the pointer 64 with the cable.

To utilize the device 10, harness 40 attached to the loop end 38 of cable 36 is secured about a portion of the body to be treated, such as the knee. The cable 36 is extended for such purpose from the slot 34 of the tube 28 at an angle toward the injury site against the bias of spring 56. Movement of the body portion being treated relative to the tube 28 anchored by frame 12 will cause movement of the cable within the tube to vary the bias exerted by the spring 56 and the exercising force thereby developed in the cable. The force so developed will be registered on the indicator 42.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In an exercising device having a frame adapted to be clamped to an anchorage, a harness adapted to embrace a portion of the human anatomy, a force transmitting cable connected to said harness, and a spring mechanism operatively connecting the cable to the frame for yieldingly resisting displacement of the cable to develop an exercising force transmitted therethrough to the harness, the improvement residing in a vertically elongated tube connected to the frame and projecting upwardly therefrom, a pulley rotatably mounted within the tube in engagement with the cable, and means supporting the spring mechanism within the tube above the pulley for reaction of the spring mechanism between the cable and the frame, said tube having upper and lower end portions, said lower end portion having a slot through which the cable extends from the pulley externally of the tube to the harness with angular flexability, said slot extending vertically downward from said supporting means in alignment with the pulley.

2. The improvement as defined in claim 1 including indicating means mounted on the housing and connected to the cable for registering the force developed in response to displacement of the cable against the bias of the spring mechanism.

3. The improvement as defined in claim 2 wherein said indicating means includes a pointer connected to the abutment means and projecting from the housing through a vertical guide slot formed therein, and a force signifying scale mounted externally on the housing parallel to the guide slot.

4. The improvement as defined in claim 1 wherein said spring mechanism includes a compression coil spring having opposite axial ends, one of the axial ends being engageable with the suppoting means within the tube, and movable abutment means mounted on the cable within the upper end portion of the tube for engagement with the spring at the other of the axial ends thereof.

5. The improvement as defined in claim 4 including stop means mounted on the cable externally of the tube for engagement therewith at the slot under the bias of the spring mechanism.

6. The improvement as defined in claim 1 including stop means mounted on the cable externally of the tube for engagement therewith.

* * * * *